US009267478B2

(12) United States Patent
Padgett, III et al.

(10) Patent No.: US 9,267,478 B2
(45) Date of Patent: Feb. 23, 2016

(54) STARTER MOTOR WITH MULTIPLE POSITION MOUNTING DEVICE AND METHOD THEREOF

(71) Applicants: Robert Bosch, LLC, Broadview, IL (US); Robert Bosch GmbH, Stuttgart (DE)

(72) Inventors: Fred M. Padgett, III, Naperville, IL (US); Gwendolyn McDonald, Barrington Hills, IL (US)

(73) Assignee: Robert Bosch GmbH, Stuttgart (DE)

( * ) Notice: Subject to any disclaimer, the term of this patent is extended or adjusted under 35 U.S.C. 154(b) by 533 days.

(21) Appl. No.: 13/712,315

(22) Filed: Dec. 12, 2012

(65) Prior Publication Data

US 2014/0158078 A1 Jun. 12, 2014

(51) Int. Cl.

| | |
|---|---|
| ***F02N 11/06*** | (2006.01) |
| ***F02N 11/00*** | (2006.01) |
| ***F02N 11/08*** | (2006.01) |
| ***F02N 15/00*** | (2006.01) |

(52) U.S. Cl.

CPC ..... *F02N 11/00* (2013.01); *F02N 11/087* (2013.01); *F02N 15/006* (2013.01); *F02N 2250/02* (2013.01)

(58) Field of Classification Search

CPC ..... F02N 11/087; F02N 11/0859; F02N 2250/02; F02N 15/006; F02N 15/067

USPC ..... 123/179.25, 195 A, 195 E

See application file for complete search history.

(56) References Cited

U.S. PATENT DOCUMENTS

| | | | | |
|---|---|---|---|---|
| 5,720,247 | A | 2/1998 | Suzuki et al. | |
| 5,945,755 | A | 8/1999 | Ohmi et al. | |
| 6,759,756 | B2 | 7/2004 | Shiga et al. | |
| 8,001,943 | B2 | 8/2011 | Kaneda et al. | |
| 2003/0062800 | A1* | 4/2003 | Nagai | 310/261 |
| 2007/0139146 | A1* | 6/2007 | Kusumoto et al. | 335/131 |
| 2009/0020093 | A1* | 1/2009 | Kaneda et al. | 123/179.25 |
| 2009/0206965 | A1* | 8/2009 | Niimi | 335/106 |
| 2011/0198862 | A1* | 8/2011 | Yamada | 290/38 R |

FOREIGN PATENT DOCUMENTS

| | | |
|---|---|---|
| EP | 2080897 A2 | 7/2009 |
| FR | 2962496 A1 | 1/2012 |

OTHER PUBLICATIONS

International Search Report and Written Opinion corresponding to PCT Application No. PCT/US2013/073941, mailed Jan. 23, 2015 (14 pages).

* cited by examiner

*Primary Examiner* — Hai Huynh
*Assistant Examiner* — Gonzalo Laguarda
(74) *Attorney, Agent, or Firm* — Maginot Moore & Beck LLP

(57) ABSTRACT

An engine starter including a motor, an electromagnetic switch, an auxiliary switch, a housing, and a mounting member for the auxiliary switch. The mounting member is disposed at the housing between the housing and the motor and electromagnetic switch. The mounting member includes a flange including a tab to mount the auxiliary switch.

23 Claims, 4 Drawing Sheets

STARTER MOTOR WITH MULTIPLE POSITION MOUNTING DEVICE AND METHOD THEREOF

FIELD

The disclosure relates generally to a starter and more particularly to an engine starter for use with an internal combustion engine.

BACKGROUND

Electric starter motors are commonly used to start internal combustion engines including gasoline and diesel powered engines. The electric starter includes a motor, an electromagnetic switch, and an auxiliary switch, and initiates rotation of a flywheel of the engine sufficient to enable the engine to run under the combustion power resulting from ignition of a gasoline or a diesel fuel.

The electric starter motor includes an electric motor which can be either a permanent-magnet or a series-parallel wound direct current electric motor which is electrically coupled to a vehicle battery through an electromagnetic switch, known as a starter solenoid. When current from the battery is applied to the electromagnetic switch either through turning of a key or by pressing a start button, current is applied to the electric motor. Upon energization, the solenoid engages a lever that pushes a drive pinion on a driveshaft of a starter driveshaft to engage the flywheel of the engine. Thus, rotational torque of the electric motor is transferred to the engine through the pinion to thereby start up the engine.

To smoothly start up the engine, a rotational torque of the electric motor is transferred to a drive pinion gear after the drive pinion gear engages the flywheel of the engine. In addition, once the engine has reached an operating speed, the pinion gear must be disengaged from the flywheel. Consequently, the operation of electric motor, and in particular the engagement of the pinion gear with the flywheel, should be synchronized with the engine to properly engage and disengage the flywheel.

To provide for proper synchronization, the engine starter also includes an auxiliary switch. Upon turning of the key or pressing of the starter button, the magnetic coil in the electromagnetic switch is energized. In response, a plunger is driven and the auxiliary switch is closed by the plunger. Consequently, a limited amount of current is supplied to the electric motor, thereby driving the electric motor to at a low number of revolutions per minute. The pinion gear then engages the flywheel. As the plunger is driven further, the electromagnetic switch is closed, and a larger amount of electric current is supplied to the electric motor to increase the number of revolutions per minute. The pinion gear engaging the flywheel is then driven by the electric motor to provide sufficient torque to turn the flywheel such that the engine starts and can continue operation from internal combustion in the engine.

Because the electric starter is mechanically and directly linked to the engine flywheel, the electric starter is placed in close proximity to the engine within the engine compartment. In addition, since the starter not only includes the motor, the electromagnetic switch, and the auxiliary switch, but also a housing to support the various components, the space requirements with respect to the arrangement of the various components should be considered. In particular, the amount of space available within an engine compartment is often limited. What is needed therefore is a system, mechanism, or structure by which the starter is configured to be properly located with respect to the engine to provide an electrical and mechanical advantage. In addition, because space is at a premium in an engine compartment, the location of the individual components of a starter should provide for the advantageous location of the starter within a variety of different sizes and shapes of engine compartments and also to provide for ease of access to the various components if one or more of the components requires a replacement or repair in case of a failure.

SUMMARY

In accordance with one embodiment of the present disclosure, there is provided a mounting member for an engine starter having a motor, an electromagnetic switch, an auxiliary switch, and a housing including an outer perimeter and configured to receive the motor and the electromagnetic switch. The mounting member includes a first mounting section defining a first aperture configured to receive a portion of the electromagnetic switch, and a second mounting section coupled to the first mounting section and defining a second aperture configured to receive a portion of the motor. One of the first mounting section and the second mounting section includes a flange configured to extend past the outer perimeter of the housing when the mounting member is aligned with the housing to receive the electromagnetic switch and the motor.

In accordance with another embodiment of the present disclosure, there is provided an engine starter including a motor, an electromagnetic switch, an auxiliary switch, and a housing including an outer perimeter, wherein at least a portion of the motor and a portion of the electromagnetic switch are disposed in the housing. The starter also includes a mounting member having a first mounting section and a first aperture disposed in the first mounting section, wherein the first aperture is configured to receive the electromagnetic switch. A second mounting section of the mounting member is coupled to the first mounting section and a second aperture is disposed in second mounting section, wherein the second aperture is configured to receive the motor. The mounting member is disposed adjacent to the housing and one of the first mounting section and the second mounting section includes a flange configured to extend past the outer perimeter of the housing.

In accordance with still another embodiment of the present disclosure there is provided a mounting member for an engine starter having a motor, an electromagnetic switch, an auxiliary switch, and a housing including an outer perimeter and configured to receive the motor and the electromagnetic switch. The mounting member includes a mounting section defining an aperture configured to receive a portion of one of the motor and the electromagnetic switch. The mounting section includes a flange configured to extend past the outer perimeter of the housing when the mounting member is aligned with the housing to receive one of the motor and the electromagnetic switch wherein the flange is configured to provide a mounting location to mount the auxiliary switch.

DESCRIPTION

Figure 1:
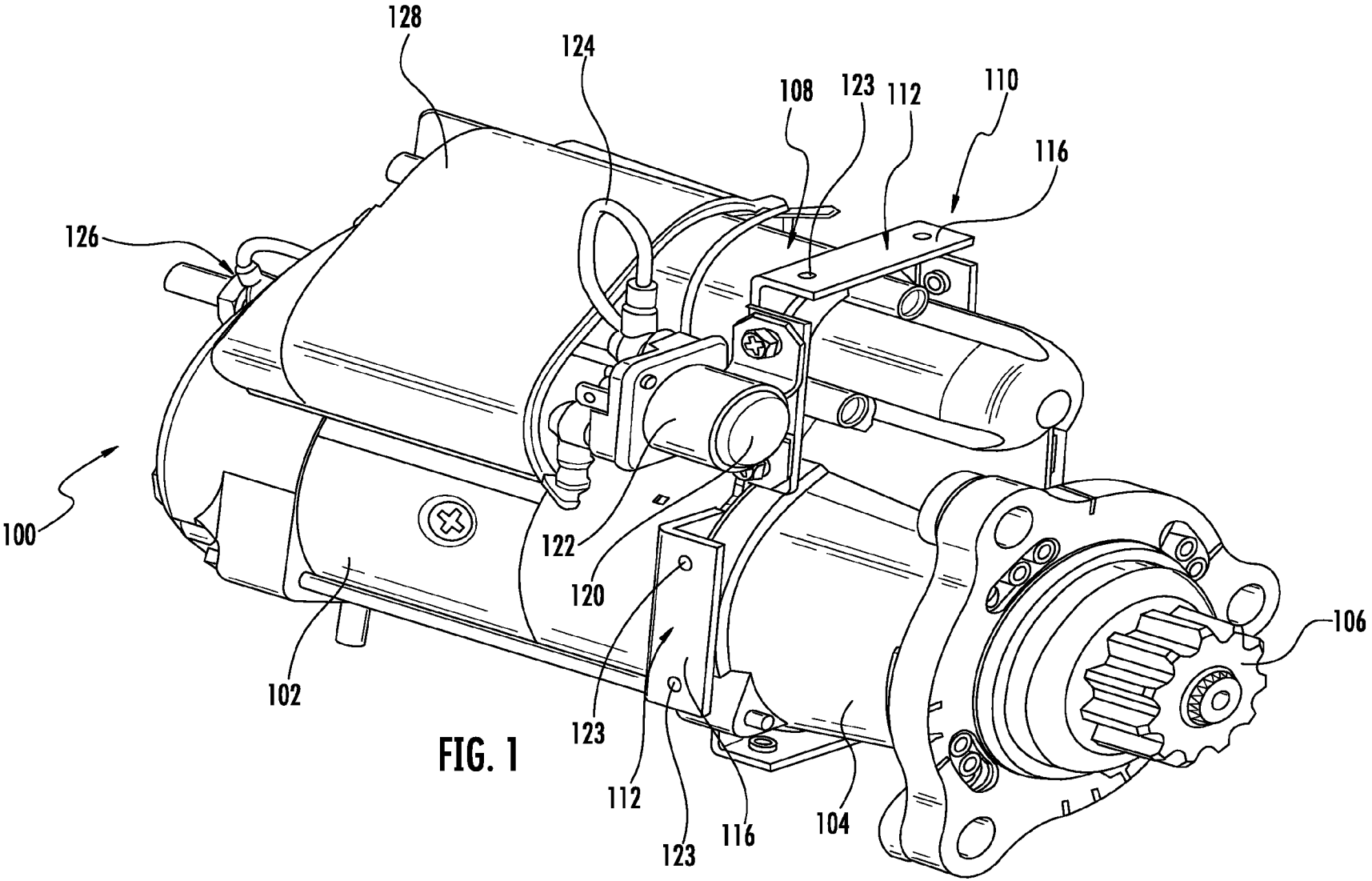
FIG. 1 is an elevational perspective of an engine starter.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

FIG. 1 is a perspective view of an engine starter 100. The engine starter 100 includes a motor 102, operatively coupled to a housing 104 supporting a pinion gear 106. An electromagnetic switch 108, such as a solenoid, is disposed adjacent to the motor 102 and is also operatively coupled to the housing 104. A mounting member 110 is disposed between housing 104 and the motor 102 and the electromagnetic switch 108. The mounting member 110 includes a plurality of flanges 112, which are illustrated with additional detail in FIGS. 2 and 3, each of which extends from a planar portion 114 of the mounting member 110. (See FIG. 2) One or more of the flanges 112 terminates in a tab 116. In one embodiment, when the mounting member 110 is aligned with the housing 104, each of the flanges 112 extends past an outer perimeter of the housing 104 to provide a mounting location for an auxiliary switch 120.

The mounting member 110 is held in place between the housing 104 and a portion of the motor 102 and/or a portion of the switch 108 by the assembly of these components into the starter 100. The mounting member 110, which is fixed in location due to placement between the various components of the starter 100, includes coupled thereto the auxiliary switch 120. The auxiliary switch 120 is fixed to the mounting member 110 by a bracket 122. The bracket 122 is coupled to one of the flanges 112 of the mounting member 100 at one or more mounting features, such as apertures 123 disposed in the flange 112. The auxiliary switch 120 is electrically coupled to a vehicle battery by at least one wire 124 which is coupled to a connector 126 located at one end of the starter motor 100. The switch 108 also includes at least one wire coupled to a connector (not shown) also disposed at the end of the starter motor at which the connector 126 is located. A cover 128 is attached to either one or both of the motor 102 and the switch 108 to provide a barrier between the wires and any external forces which could damage the motor 102, the switch 108, and the wires at that location.

Figure 2:
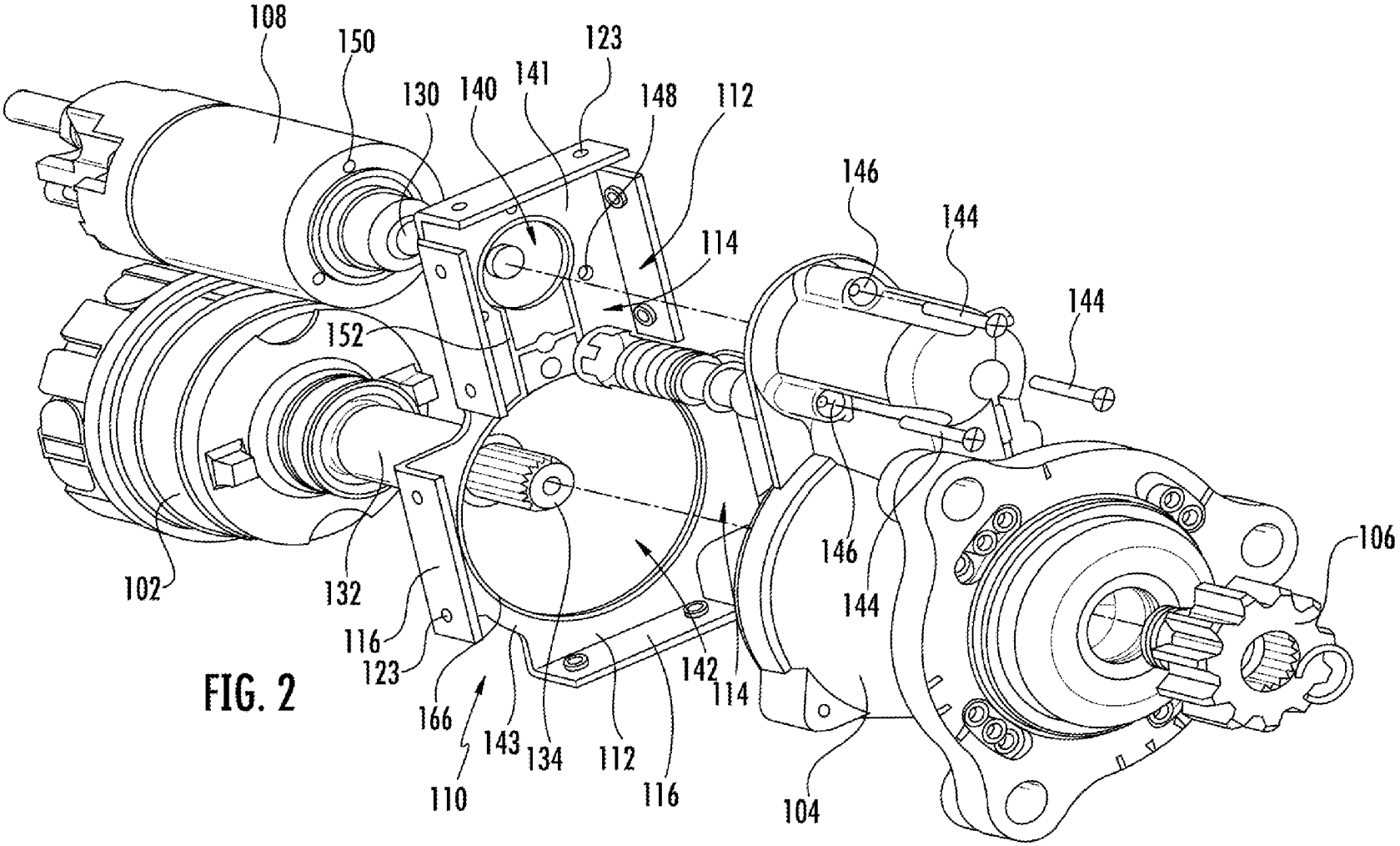
FIG. 2 is an elevational exploded perspective view of the engine starter of FIG. 1.

As further illustrated in an exploded perspective view of FIG. 2, the switch 108 includes a plunger 130 which is disposed within the housing 104 upon assembly of the housing to the motor 102 and the switch 108. The motor 102 includes a drive shaft 132 which is also disposed within the housing 104 upon assembly of the housing. A geared end 134 of the drive shaft 132 engages the pinion gear 106 for driving the flywheel of the engine.

Figure 3:
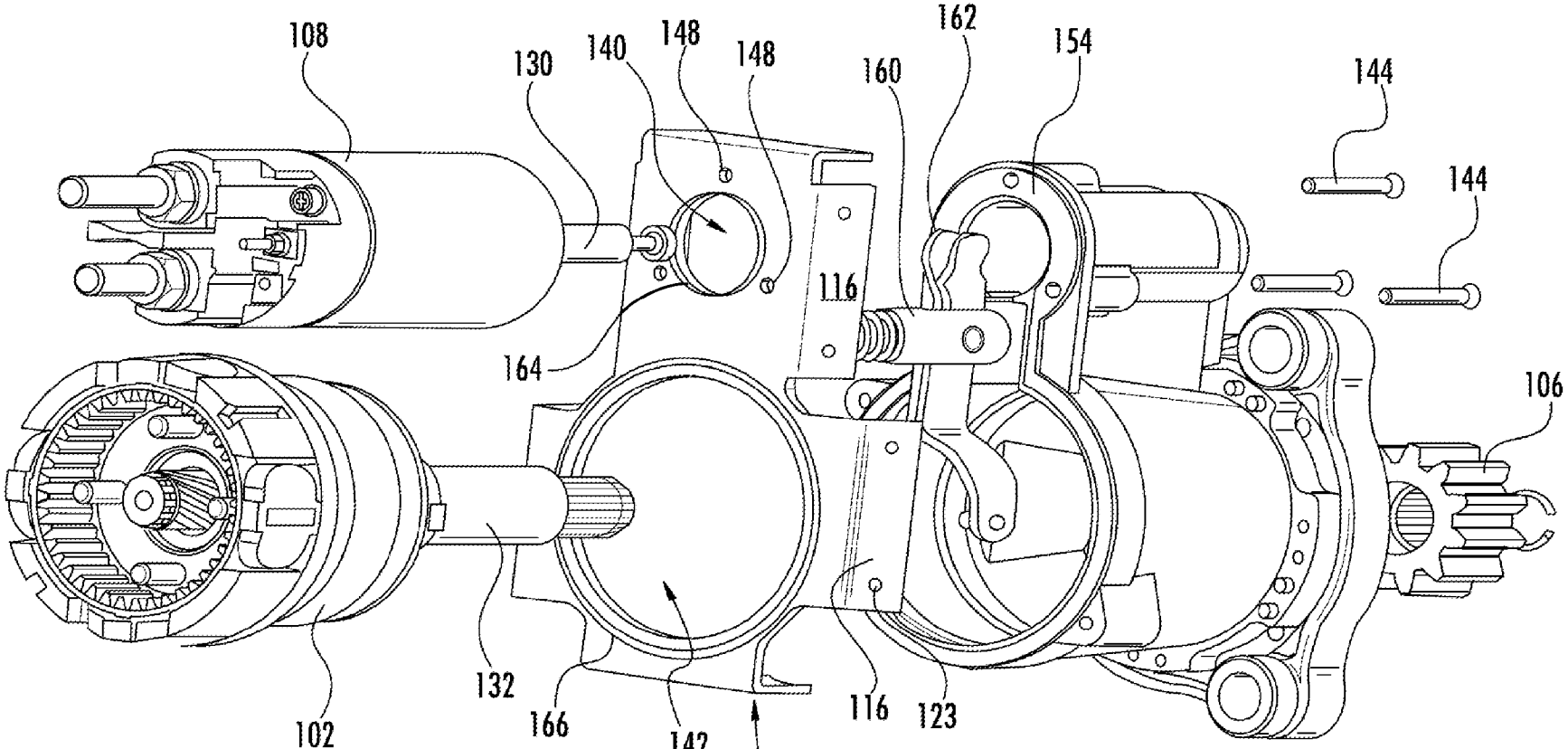
FIG. 3 is an elevational exploded perspective view of the engine starter of FIG. 1 from a different perspective from that shown in FIG. 2.

To provide for the assembly of the switch 108 and the motor 102 to the housing 104, the mounting member 110 includes a first aperture 140 in a first mounting section 141 through which the switch 108 is inserted for engagement in the housing. The mounting member 110 includes a second aperture 142 in a second mounting section 143 through which the motor 102 is inserted for engagement with the pinion gear 106. While the first mounting section 141 is shown coupled to the second mounting section 143, in other embodiments the first mounting section 141 and the second mounting section 143 are separate components. Once the switch 108 and the motor 102 engage the respective components supported by or within the housing 104, the mounting member 110 is fixed between the housing 104 and the described components by a plurality of fasteners 144, such as screws or bolts, which are inserted through apertures 146 in the housing 104, through apertures 148 in the mounting member 140, and into apertures 150 in the switch 108. The mounting member 110 also includes a patterned seal 152 (See FIG. 2) on a first planar side of the member 110 which interfaces with a machined surface 154 at the housing 104, as illustrated in FIG. 3, or with the housing itself if no machined surface 154 is present. The machined surface 154 is configured to engage the patterned seal 152 to provide a seal between the mounting member 110 and the housing 104. In one embodiment, the machined surface 154 includes a defined channel or depression corresponding to the patterned seal 152 where the channel or depression can be smooth, roughened or patterned.

FIG. 3 illustrates a perspective view of the motor starter 100 from a different perspective than that illustrated in FIG. 2. As illustrated, the plunger 130, which extends from the switch 108, extends into the housing 104 and also engages a shift lever 160. The shift lever 160 extends generally vertically as illustrated and includes an engagement feature 162 which receives an end portion of the plunger 130. Once the switch 108 is energized, the plunger 130 moves the shift lever 160 which in turn is coupled to the drive shaft 132, and which upon movement responsive to the shift lever 160, moves the pinion gear 106 into engagement with the flywheel.

As illustrated in FIG. 3, the mounting member 110 includes on a second planar side having a first gasket 164 circumferentially disposed about the first aperture 140 which provides a seal between a surface of the switch 108 and the mounting member 110. A second gasket 166 is circumferentially disposed about the second aperture 142 to provide a seal between a surface of the motor 102 and the mounting member 110.

As illustrated in FIGS. 2 and 3, each of the flanges 112 terminates in a tab or tab portion 116. The tabs 116 are generally inclined with respect to the plane of the mounting member 110 and provide the apertures 123 for mounting of the bracket 122 illustrated in FIG. 1 which in turn supports the auxiliary switch 120. In the illustrated embodiment, the tabs 116 are perpendicular to the plane of the mounting member 110. While each of the flanges is illustrated as including a tab portion 116, in some embodiments not all flanges 112 terminate in a tab portion 116. In other embodiments of the mounting member 110, only one of the flanges is necessary, if the location of the auxiliary switch is known. In these instances, material cost savings are achieved since less material is necessary to produce the mounting member 110. In other embodiments, more than one flange 112 is included in the mounting member 110, and the number of flanges 112 exceeds the number illustrated in the figures. In addition, in another embodiment, the tabs 116 need not be located at an angle generally perpendicular to the plane of the 110, but are at other angles provided sufficient room exists to mount the auxiliary solenoid. In other embodiments, the tabs are completely eliminated, such that the flanges 112 extend along the planar engaging surface of the mounting member 110. In such an embodiment, the flange 112 extends past an outer perimeter of the housing 104 and includes apertures for mounting the auxiliary switch 120.

Figure 4:
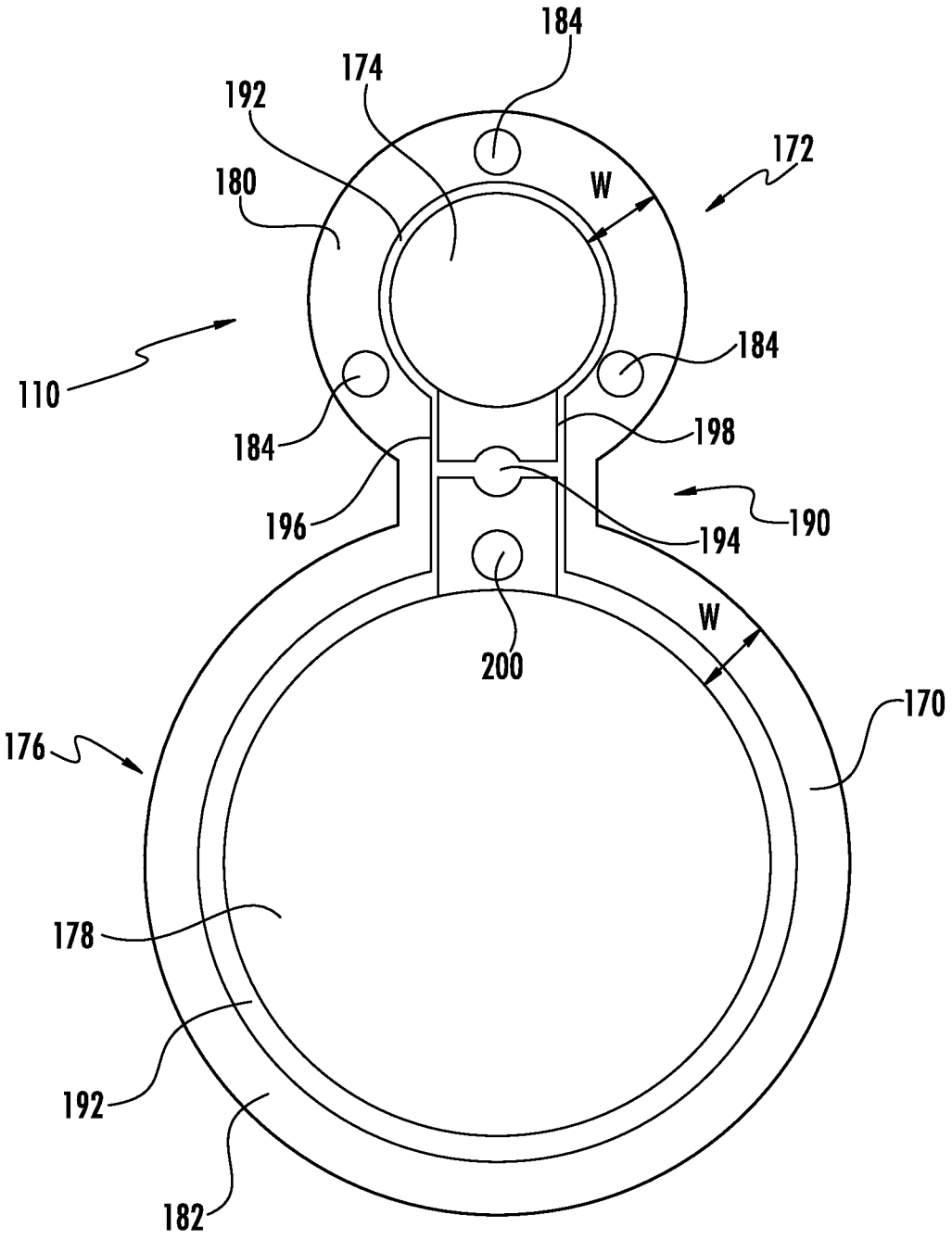
FIG. 4 is a plan view of one embodiment of a mounting member.

One such embodiment of the mounting member 110 is illustrated in FIG. 4. As seen in FIG. 4, a first planar side 170 includes a first mounting section 172 having a first aperture 174 centrally disposed within the first mounting section 172. A second mounting section 176 includes a second aperture 178 centrally disposed in the second mounting section 176. Each of the first and second apertures 174 and 178 include a diameter respectively sufficient to receive a portion of the switch 108 and a portion of the motor 102. In addition, each of the first and second mounting sections 172 and 176 respectively include a circumferential ring of material 180 and 182. Each of the circumferential rings of material includes a width, W, sufficient to extend past corresponding surfaces on the motor 102, the switch 108 and the housing 104. By adjusting the width of the circumferential rings of material, a portion of the circumferential rings extends past and away from the other structures of the starter 100, such that a plurality of mounting apertures 184 are accessible once the various components of the starter 100 are assembled. The plurality of mounting apertures 184 are then used to mount the auxiliary switch 120 to the assembly.

In one embodiment, the auxiliary switch 120 includes a housing having an integral mounting bracket formed in the housing with which to mount the auxiliary switch to the mounting member 110. In another embodiment, the mounting bracket is a separate part, as illustrated in FIG. 1, which captures and holds in place the auxiliary switch 120 to the mounting member 110. While three mounting apertures 184 are illustrated as being located at the first section 172, other numbers and other locations of apertures within the first section 172 are possible. In addition, while the second mounting section 176 is illustrated as lacking an aperture, one or more apertures at one or more locations in other embodiments are located in the second mounting section 176.

The first mounting section 172 and the second mounting section 176 are operatively coupled together by a third section 190 generally disposed between the two sections and having an outline which generally follows the outline of the mounting surface of the housing 104 which includes the machined surface 154 FIG. 3. In another embodiment the first mounting section 172 and second mounting section 176 are separate components or parts. The planar surface of the mounting member 110 includes a mating structure 192 which encircles the first aperture 174, extends across the third section 190 and encircles the second aperture 178. In addition, the mating structure 192 includes a cross-member 194 which extends from a first line structure 196 to a second line structure 198 of the structure 192.

The mating structure 192 provides a seal between the machined surface 154 or the housing 104 and the mounting member 110 to provide a sealing function. The mating structure 192, in different embodiments, includes materials such as rubber, felt, and plastic but is not limited to those materials. In addition in other embodiments, the mating structure 192 is an adhesive which adheres the mounting member 110 to the machined surface 154 or to the housing 104 in the absence of a machined surface or gasket. The mounting member 110 also includes one or more apertures 200 which accept fasteners to fasten the housing 104 to other components or parts of the starter motor 100.

As seen in FIG. 3, the mounting member 110 also includes a mating structure or gasket 164 and a mating structure or gasket 166 which provide a sealing function between the mounting member 110 and surfaces of the motor 102 and switch 108. While not illustrated in FIG. 4, such mounting members in other embodiments are also located on the obverse side of the illustrated embodiment. Consequently, other embodiments of the mounting member 110 include mating structures on one or on both sides of the mounting member 110. In addition, other configurations of the mounting members are possible. For instance, while the mounting member 192 of FIG. 4 includes a cross-member 194, a first line structure 196, and a second line structure 196, the mounting members of FIG. 3 do not include a first line structure, a second line structure, and a cross-member. Such mating structures are therefore configured to provide a sealing function with one or more of the components or parts of the motor 100 as desired.

While the invention has been illustrated and described in detail in the drawings and foregoing description, the same should be considered as illustrative and not restrictive in character. For instance in one embodiment of the mounting member 110 of FIG. 4, the third section 190 includes an aperture which connects the first aperture 174 and second aperture 178, such that one aperture is located within the mounting member 110. In another embodiment, the mounting member 110 of FIGS. 2 and 3 include a single aperture. It is therefore understood that only the preferred embodiments have been presented and that all changes, modifications and further applications that come within the spirit of the invention are desired to be protected.

What is claimed is:

1. A mounting member for an engine starter having a motor, an electromagnetic switch, an auxiliary switch, and a housing including an outer perimeter and configured to receive the motor and the electromagnetic switch, the mounting member comprising:

a first mounting section defining a first aperture configured to receive a portion of the electromagnetic switch; and a second mounting section coupled to the first mounting section and defining a second aperture configured to receive a portion of the motor, wherein one of the first mounting section and the second mounting section includes a flange configured to extend past the outer perimeter of the housing when the mounting member is aligned with the housing to receive the electromagnetic switch and the motor, and wherein the first mounting section is configured to be fixed between the electromagnetic switch and the housing and the second mounting section is configured to be fixed between the motor and the housing.

2. The mounting member of claim 1 wherein the flange includes a mounting feature configured to provide a mounting location to mount the auxiliary switch.

3. The mounting member of claim 2 wherein the flange includes a tab, the tab extending from the flange out of a plane in which the one of the first and second mounting sections is arranged.

4. The mounting member of claim 3 wherein the first mounting section includes the flange.

5. The mounting member of claim 4 wherein the mounting feature is disposed at the tab and includes an aperture.

6. The mounting feature of claim 1 wherein the first mounting section includes a plurality of flanges disposed about the first aperture and the second mounting section includes a plurality of flanges disposed about the second aperture.

7. The mounting member of claim 6 wherein at least one of the plurality of flanges includes a mounting feature configured to provide a mounting location to mount the auxiliary switch.

8. The mounting member of claim 7 wherein the at least one of the plurality of flanges includes a tab extending from the at least one of the plurality of flanges out of a plane of in which the one of the first mounting section and second mounting section is arranged.

9. The mounting member of claim 1 further comprising a mating structure disposed on a surface of the mounting member, the mating structure circumferentially surrounding the portion of the electromagnetic switch and the portion of the motor, and contacting the housing between the electromagnetic switch and the motor to provide sealing contact between the mounting member and the housing.

10. An engine starter comprising:

a motor;

an electromagnetic switch;

an auxiliary switch;

a housing including an outer perimeter, wherein at least a first portion of the motor and a first portion of the electromagnetic switch are disposed in the housing; and a mounting member including (i) a first mounting section defining a first aperture, which receives a second portion of the electromagnetic switch, and (ii) a second mounting section coupled to the first mounting section and defining a second aperture, which receives a second portion of the motor, wherein the mounting member is disposed adjacent to the housing, and wherein the one of the first mounting section and the second mounting section includes a flange extending past the outer perimeter of the housing.

11. The engine starter of claim 10 wherein the auxiliary switch is mounted on the flange.

12. The engine starter of claim 11 wherein the flange includes a mounting feature configured to provide a mounting location for the auxiliary switch.

13. The engine starter of claim 12 wherein the flange includes a tab extending from the flange out of a plane in which the one of the first mounting section and the second mounting section is arranged.

14. The engine starter of claim 13 wherein the first mounting section includes a plurality of flanges each including a tab, the plurality of flanges being disposed about one of the first mounting section and the second mounting section.

15. The engine starter of claim 14 wherein the first mounting section and the second mounting section each include the plurality of flanges.

16. The engine starter of claim 15 wherein each of the tabs includes a mounting feature.

17. The engine starter of claim 10 wherein the mounting member includes a mating structure disposed on a surface of the mounting member, the mating structure circumferentially surrounding the second portion of the electromagnetic switch and the second portion of the motor, and contacting the housing between the electromagnetic switch and the motor to provide a seal with the housing.

18. The engine starter of claim 16 further comprising a bracket coupled to one of the tabs, wherein the auxiliary switch is located between the bracket and one of the tabs.

19. A mounting member for an engine starter having a motor, an electromagnetic switch, and an auxiliary switch, and a housing including an outer perimeter and configured to receive the motor and the electromagnetic switch, the mounting member comprising:

a mounting section defining an aperture configured to receive a portion of one of the motor and the electromagnetic switch, the mounting section including a flange configured to extend past the outer perimeter of the housing when the mounting member is aligned with the housing to receive the one of the motor and the electromagnetic switch;

wherein the flange is configured to provide a mounting location to mount the auxiliary switch, and wherein the mounting member is configured to be fixed between the housing and the one of the motor and the electromagnetic switch.

20. The mounting member of claim 19 wherein the flange includes a plurality of tabs configured to provide one or more mounting locations to mount the auxiliary switch.

21. The mounting member of claim 1 further comprising:

one of a gasket and a mating structure positioned at the first aperture circumferentially surrounding the electromagnetic switch and configured to contact the mounting member and the electromagnetic switch so as to seal between the electromagnetic switch and the mounting member.

22. The starter motor of claim 10 further comprising one of a gasket and a mating structure positioned at the first aperture circumferentially surrounding the electromagnetic switch and contacting the mounting member and the electromagnetic switch so as to seal between the electromagnetic switch and the mounting member.

23. The starter motor of claim 10 wherein the first mounting section is fixed between the housing and the electromagnetic switch and the second mounting section is fixed between the housing and the motor.

* * * * *